US005585568A

United States Patent [19]

Moncrief et al.

[11] Patent Number: 5,585,568

[45] Date of Patent: Dec. 17, 1996

[54] FORCE SENSING ASSEMBLY AND METHOD FOR A PRODUCT DELIVERY SYSTEM

[75] Inventors: Frank Moncrief, Acworth; David R. Bacco, Canton, both of Ga.

[73] Assignee: Riverwood International Corporation, Atlanta, Ga.

[21] Appl. No.: 404,225

[22] Filed: Mar. 15, 1995

[51] Int. Cl.[6] ..... G01N 3/00

[52] U.S. Cl. ..... 73/788; 73/762; 414/798.9

[58] Field of Search ..... 73/788, 862.541, 73/862.55, 862; 414/798.9, 907

[56] References Cited

U.S. PATENT DOCUMENTS

| | | | |
|---|---|---|---|
| 4,041,853 | 8/1977 | Verwey et al. | 414/789.9 |
| 4,162,869 | 7/1979 | Hitomi et al. | 414/796.5 |
| 4,501,528 | 2/1985 | Knapp | 414/273 |
| 5,374,151 | 12/1994 | Mattews | 414/392 |

*Primary Examiner*—Richard Chilcot
*Assistant Examiner*—Max H. Noori

[57] ABSTRACT

A force sensing assembly measures a magnitude of a force generated at the tabs in a product delivery system. The product delivery system can be one in which a force is produced at the tabs by the weight of the stack, by a paddle pushing an end of the stack, or by another similar type of advancing mechanism. In a preferred embodiment, the force sensing assembly has a pair of tabs connected to a cross-bar which extends across the stack and which is connected to the frame of the feeder through a bell crank at one end and a lever at the other end. The bell crank has one arm connected to the cross-bar and a second arm connected to a load cell. The force at the tabs causes the lever and bell crank to rotate, with the force being transmitted through the bell crank, through a spring, and then to the load cell. The load cell generates a force signal which is supplied to a controller for adjusting the amount of force at the tabs. The controller adjusts the force by adding more products to the stack or by advancing the stack closer to the tabs. The load cell preferably has a stopper for preventing an excessive amount of force from reaching the cell.

29 Claims, 5 Drawing Sheets

FORCE SENSING ASSEMBLY AND METHOD FOR A PRODUCT DELIVERY SYSTEM

FIELD OF THE INVENTION

The invention generally relates to an assembly for sensing a force generated by a stack of products and, more particularly, to a force sensing assembly for use in a product delivery system to allow the system to consistently deliver a single product from the stack of products.

BACKGROUND OF THE INVENTION

When packaging articles, such as bottles or cans, into a carton or other suitable container, the articles are typically separated into discrete groups of articles and each group of articles is then placed into a carton. Frequently, an insert or other suitable type of partition is placed between the articles to prevent the articles from colliding with each other. During the packaging process, a stack of cartons is formed, a single carton is selected from the stack, and the single carton is delivered to a carton transport assembly which places the carton in a position to receive the group of articles. Similarly, a stack of inserts is formed, a single insert is selected from the stack, and the single insert is placed into position between the individual articles in the group.

The existing packaging machines vary greatly in how they form a stack of products, which generically covers either a stack of cartons or inserts, and how they select a single product from the stack. In broad terms, however, the packaging machines form a stack of products by aligning the products face-to-face with the sides of the products abutting against some type of side rails and with the bottoms of the products resting against some type of floor. At least one tab or other type of projection typically contacts the first product in the stack to prevent that first product from separating from the stack. To remove the first product, a set of vacuum cups are moved against the first product, a vacuum is generated in the cups to securely hold the cups to the product, and then the vacuum cups along with the first product are moved away from the stack. The tab prevents the other products from leaving when the first product is removed. The removal of a single product from the stack is called "picking" the product and the position of the product which provides the best opportunity for a pick is termed the "pick plane".

It is difficult, however, to pick only one product from the stack. Some factors influencing the ease with which a product may be picked include the position of the tab or projection, the amount of pressure in the vacuum cups, and the weight of the stack against the tab or projection. The difficulty in setting the values for theses factors is that after the setting has been adjusted for one factor the settings for the other two factors might also need adjusting. Thus, the factors cannot be adjusted independently of each other.

For instance, the tabs must be positioned far enough into the product so that the force from the stack will not push the products past the tab, yet not be too far into the product so that the vacuum cups cannot remove a product. If the force supplied by the stack is too small, the vacuum cups knock the products out of the pick plane when the vacuum cups swing over for the pick. Thus, the vacuum cups will be unable to remove a product with too small of a force supplied to the tabs. On the other hand, if the force of the stack is too large for the tabbing, the tabbing cannot contain the products in the stack and the products are pushed past the tabbing. Further, while the vacuum cups must have enough pressure to overcome the resistance provided by the tabbing, the product may be torn or deformed with a heavy tabbing and a large pressure.

A common approach in the industry is to select a moderate pressure, a moderate tabbing, and to vary the amount of force supplied by the stack. The force supplied by the stack is mainly either from a component of the stack's weight or is from an external device, such as a paddle, pushing the rear of the stack.

To generate a force at the tabbing from a component of the stack's weight, the stack is formed at a downward angle with the first product being at a location lower than the last product in the stack. With this arrangement, the angle of the stack and the weight of the products in the stack will then determine the amount of force supplied at the tabbing.

The previous systems which used the weight of the stack to apply a force at the tabs adjusted the amount of the force by varying the number of products in the stack. With one system, a conveyor belt holding a reserve of products would be activated to drop more products in the stack when a photocell detected that the stack has been reduced to a certain thickness. When the stack is at that certain thickness, the stack is suppose to generate the desired force at the tabs.

A difficulty with this system is that the weight of the stack changes when the product is replaced with a different product. With a product having a different size or weight, the photocell would no longer be in the proper position and the weight of the stack would be too large or too small for the particular tabbing and for the particular pressure in the vacuum cups. While the position of the photocell could conceivably be adjusted, this would only further complicate matters by requiring an operator to precisely position the photocell.

The adjustment of the photocell would present further difficulties as well. For instance, the mechanism for dropping the products into the stack requires a certain distance between the reservoir of products and the rear of the stack in order for the products to fall into alignment with the other products in the stack. If the position of the photocell were to change, the distance between the rear of the stack and the reservoir would change which might prevent the products from falling into alignment with the other products.

With another type of system, the number of products in the stack is roughly controlled by a limit switch positioned against the first product in the stack. The function of the limit switch in this type of system is basically to inform a controller whether the first product in the stack is in the proper position for a pick. The limit switch has a spring-biased plunger which is depressed when the first product is in position. When the limit switch is not depressed, the system will increase the number of products in the stack or advance the stack closer to the tabs in order to move the first product against the limit switch.

A problem with the limit switch system is that it can only indicate whether or not the first product is in the proper position. The supply of products into the stack is simply an on/off control resulting in a variable amount of force being supplied to the tabbing. In other words, the limit switch just ensures that the force is at least above a certain level and does not prevent the force from becoming too large for a particular tab setting. The limit switch system is therefore not an ideal way for controlling the amount of force at the tabbing.

Another problem with the limit switch system is that the limit switch must be precisely located relative to the products in the stack. If the limit switch is too far away from the first product in the stack, the limit switch will cause the system to add too many products thereby producing a larger than desired force at the tabbing. When the limit switch is positioned too close to the first product, the force at the tabbing will be insufficient and the products will be knocked out of position by the vacuum cups. Further, the limit switch is a mechanical switch which has a limited life-time which will need to be replaced periodically.

A need therefore exists in the industry for a product delivery system that can consistently and reliably deliver a single product from a stack of products. A need also exists for a system that can accurately control the force supplied from a stack of products.

SUMMARY OF THE INVENTION

The invention, in one aspect, comprises a force sensing assembly for use in a product delivery system which successively removes products from one end of a stack and which forces the products toward the one end of the stack. The force sensing assembly comprises a tab for contacting a product located at the one end of the stack and for receiving a force supplied from that product. The force sensing assembly has a device for measuring the force at the tab and for generating a force signal which is supplied to a controller. Based upon the force signal, the controller adjusts the force until the force at the one end of the stack equals a desired force.

In the preferred embodiment, the tab is connected to a cross-bar which extends across the stack. A bell crank has one arm connected to the cross-bar and a second arm connected to a spring in the force measuring device. The other end of the spring is connected to a load cell for generating the force signal. The controller is preferably a programmable logic controller that receives a scaled voltage signal, a scaled current signal, or an indexed signal from a signal conditioner connected to the load cell. The controller can adjust the force in a variety of ways, such as by increasing the number of products in the stack or by advancing the stack toward the tab at the one end of the stack. A stopper is provided in the force measuring device to prevent the second arm from travelling to a point where the load cell could become damaged.

DETAILED DESCRIPTION OF THE PREFERRED EMBODIMENTS

The invention will first be described with reference to a partition feeder 10 having a paddle 12 for advancing a stack of inserts 14. It should be understood, however, that the invention is not limited to this particular type of partition feeder 10 but may be applied to feeders of other types, such as one in which the inserts 14 are biased toward one end of the stack by the weight of the inserts 14. Further, the invention may be applied in environments other than just a partition feeder, such as a carton feeder.

Figure 1A:
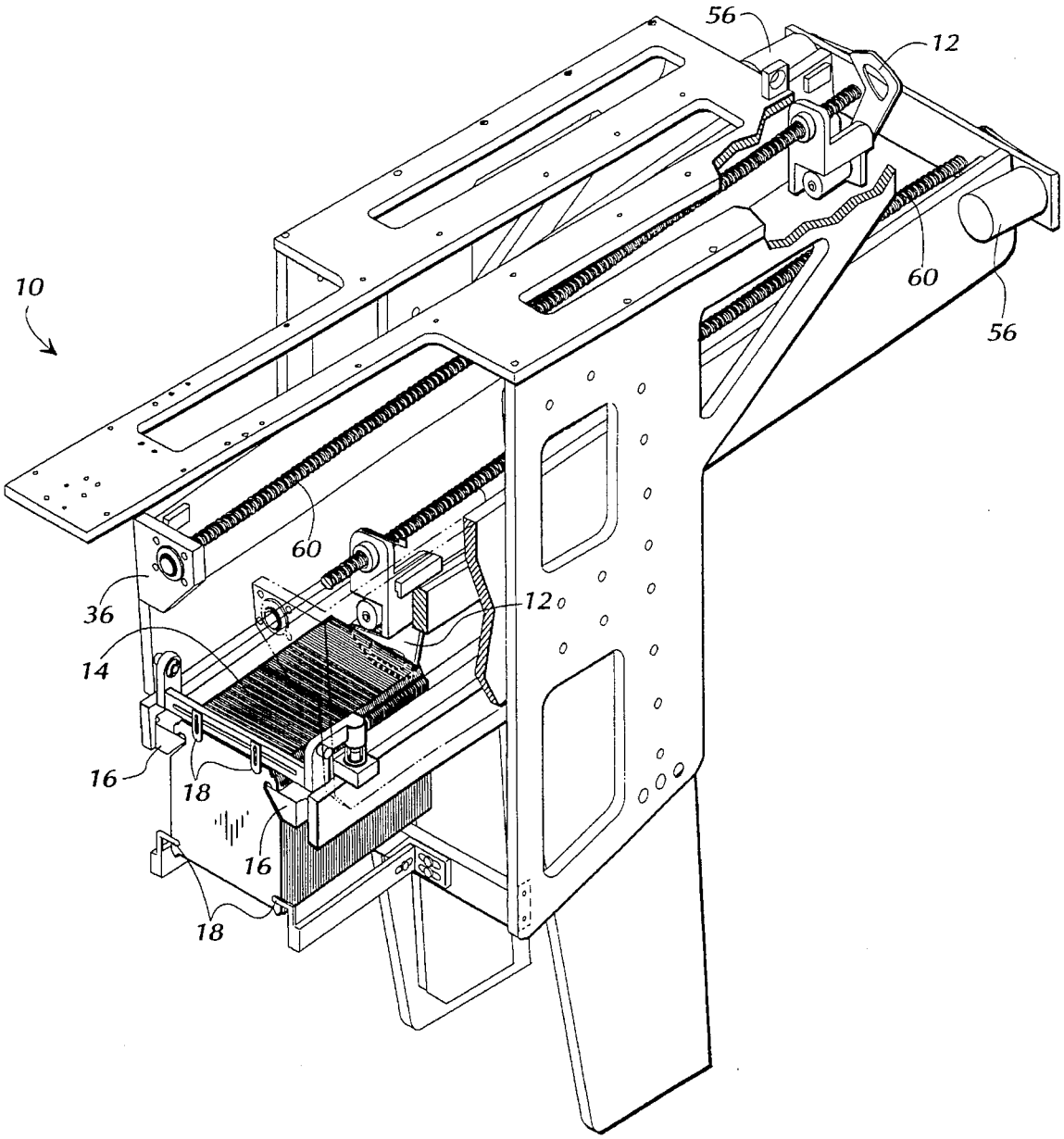
FIG. 1A is a partial perspective view of a partition feeder having a force sensing assembly according to a preferred embodiment of the invention.
Figure 1B:
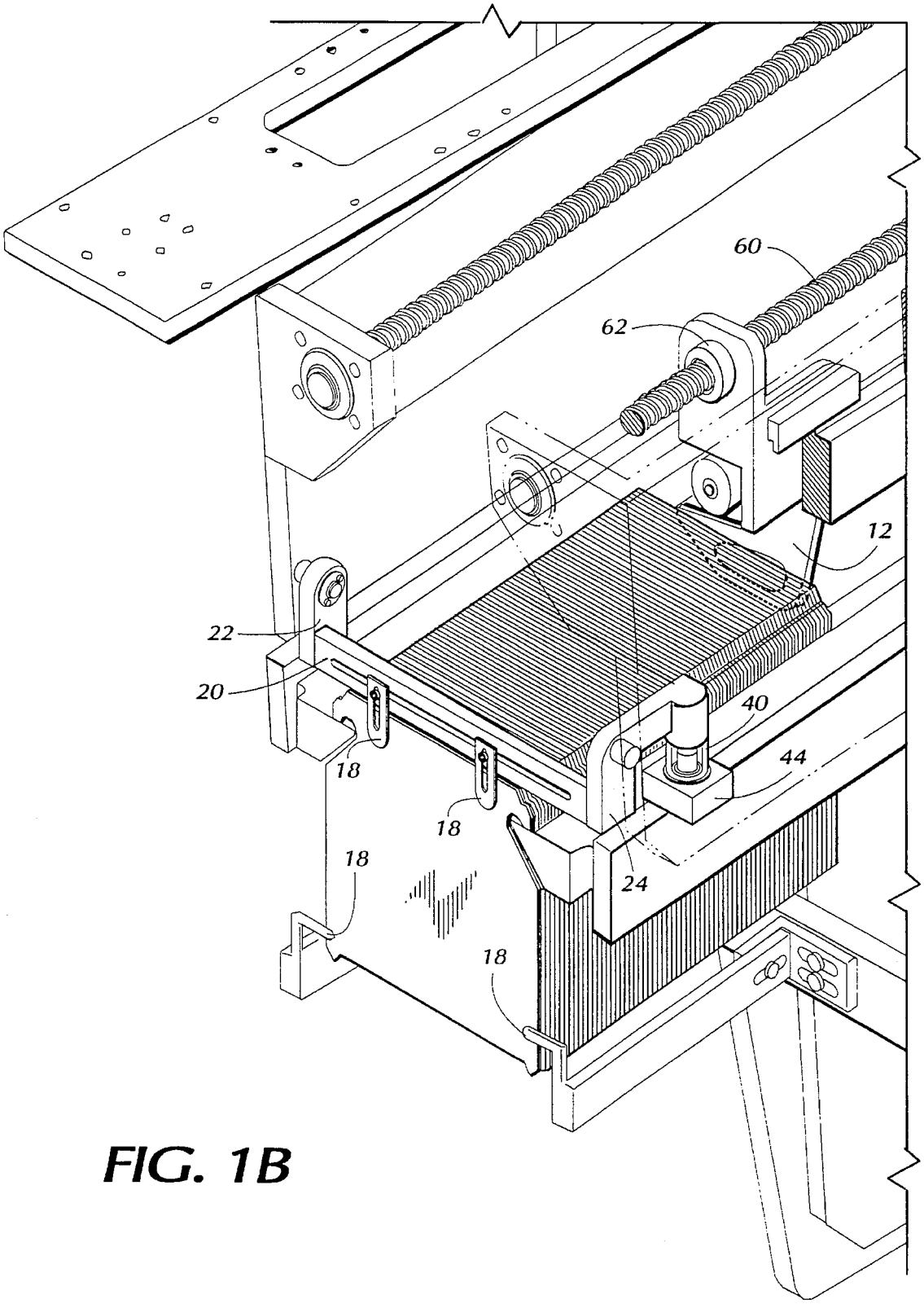
FIG. 1B is an enlarged perspective view of the force sensing assembly.

FIGS. 1A and 1B show a fragmentary view of a partition feeder 10 having a pair of side rails 16 for holding a stack of products 14, which in this particular example are partitions or inserts. The partition 14 at one end of the stack contacts a set of tabs 18 and the partition at 14 the opposite end of the stack is pushed toward the one end by the paddle 12. During operation of the partition feeder 10, a single partition 14 at the one end of the stack is removed by a set of suction cups and placed between individual articles, such as bottles. The formation of a stack of products forms no part of the present invention and any suitable assembly for forming the stack may be used.

Figure 2:
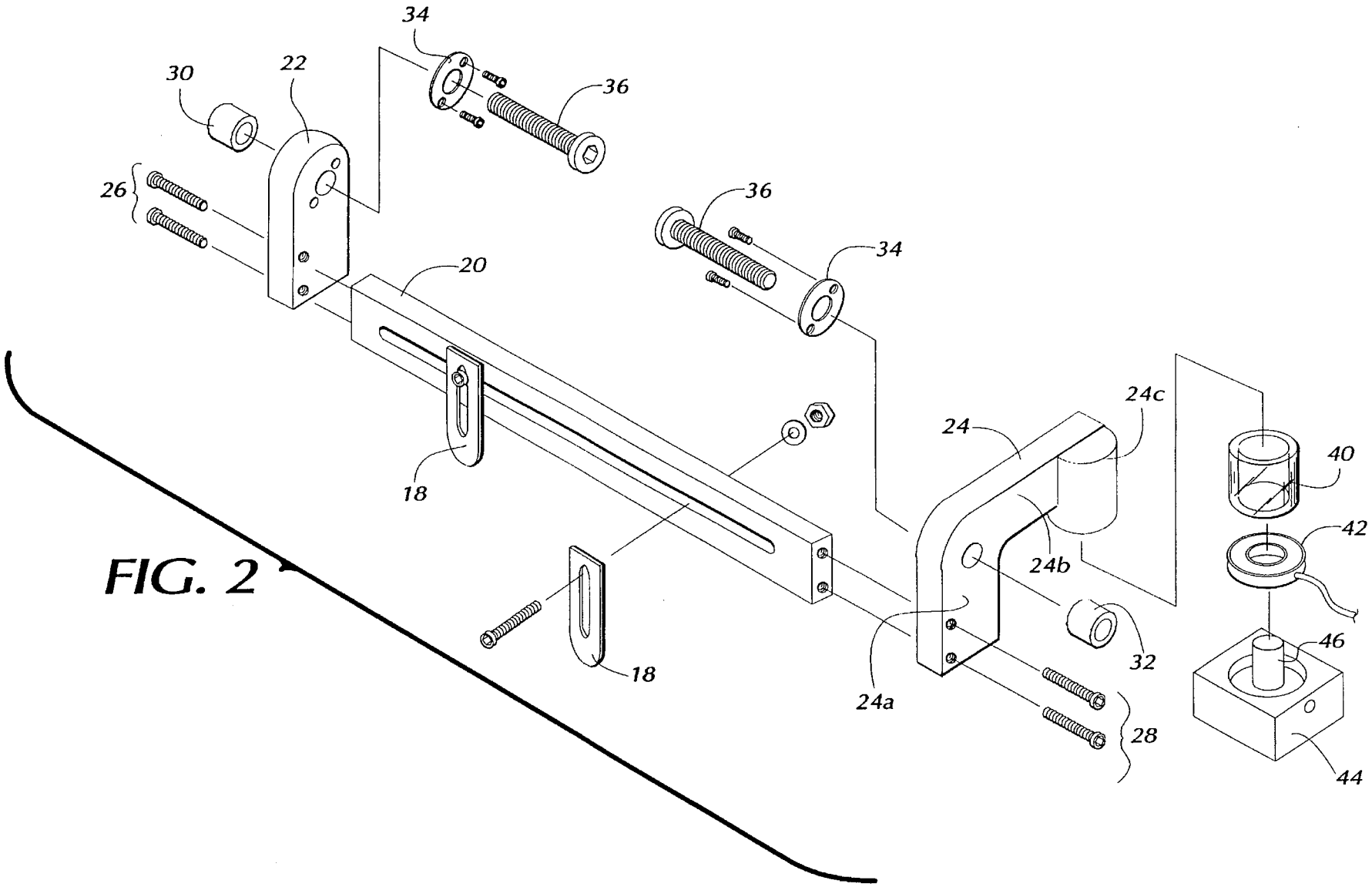
FIG. 2 is an exploded enlarged view of the force sensing assembly of FIG. 1.

As shown in FIGS. 1 and 2, the set of tabs 18 are connected to a cross-bar 20 which extends above the partitions 14. The cross-bar 20 is connected to a lever 22 at a first end with a set 26 of bolts and is connected to a bell crank 24 at a second end with a second set 28 of bolts. A needle bearing 30 is inserted into an aperture of the lever 22 and a second needle bearing 32 is inserted into an aperture of the bell crank 24. Retaining washers 34 are mounted to the inside surfaces of the lever 22 and the bell crank 24 and shoulder bolts 36 are passed through the apertures to mount the lever 22 and the bell crank 24 to a frame 36 of the partition feeder 10.

The bell crank 24 has one arm 24*a* connected to the cross-bar 20 and a second arm 24*b* connected to a spring 40 which is preferably a urethane spring. The second arm 24*b* of the bell crank 24 has a head 24*c* for receiving the end of the urethane spring 40. A load cell 42 has a load bearing surface upon which the other end of the urethane spring 40 is placed. The load cell 42 is mounted to a block 44 attached to the frame 36 of the partition feeder 10 and produces an electrical signal which varies according to the amount of force supplied to its load bearing surface.

The tabs 18 receive a force from the stack of partitions 14 which, in this example, is produced by a paddle 12 advancing the partitions 14 toward the tabs 18. The force at the tabs 18 causes the lever 22 and the bell crank 24 to rotate about an axis extending through the centers of their apertures. The force is supplied through the head 24c of the bell crank 24, to the urethane spring 40, and then to the load bearing surface of the load cell 42. Preferably, the arms 24*a* and 24*b* of the bell crank 24 have equal lengths to produce a one to one relationship between the distance that the cross-bar 20 is displaced and the distance that the spring 40 is compressed. As a protective measure, the urethane spring 40 is inserted between the bell crank 24 and the load cell 42 since the load cell 42 is limited in the distance that its load bearing surface can be deflected without causing damage to the load cell 42. The urethane spring 40 also has excellent vibration dampening properties and effectively reduces the deleterious effects of vibrations on the load cell 42.

Thus, when the force produced by the stack of partitions 14 increases, the lever 22 and bell crank 24 rotate to a greater extent. This increased force is supplied through the urethane spring 40 to the load cell 42, which generates a force signal indicating the magnitude of the force. The load cell, 42 however, can easily become damaged if a force greater than a manufacturer's specified maximum force is applied to its load bearing surface. To protect the load cell 42 from excessive forces, a stopper 46 is preferably spaced a predetermined distance from the center of the head 24*c*. The stopper 46 will contact the head 24*c* at a predefined force lower than the maximum force and prevent forces above the predefined force from reaching the load cell 42. The predetermined distance is easily determined by one of ordinary skill in the art based upon the spring constant of the urethane spring 40 and upon the manufacturer's specified maximum force for the load cell 42.

Figure 3:
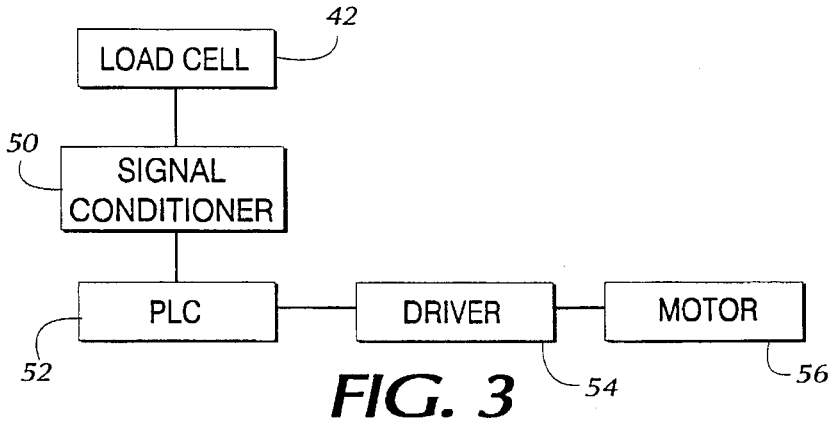
FIG. 3 is a block diagram of a force feedback system.

With reference to FIG. 3, the signals from the load cell 42 are supplied to a signal conditioner 50. The signal conditioner 50 converts the non-linear output of the load cell 42 into a linear signal and supplies the linear signal to a Programmable Logic Controller (PLC) 52. In this example, the signal conditioner 50 produces a 4 to 20 mA signal which is supplied to an analog input of the PLC 52. Instead of a current signal, the signal conditioner 50 could produce a 0 to 10 volt signal and supply this signal to the PLC 52. Also, the signal conditioner 50 could produce an indexed signal which varies with the specific range of forces within which a present force falls, such as a first signal if the force fell within a first range and a second signal if the force fell within a second range.

The PLC 52 is programmed to control the force at the tabs 18 based upon the current reading of force. The programming of a PLC 52 is within the capability of one of ordinary skill and will not be discussed in detail. In accordance with a preferred program in the PLC 52, the PLC 52 outputs a signal to a driver 54 for controlling a stepper motor 56. The stepper motor 56 can be operated at a low speed or at a high speed and also in a forward or reverse direction. The output of the stepper motor 56 is geared to drive a screw drive 60 extending along the length of the stack. The paddle 12 is attached to an assembly 62 that is mounted to the screw drive 60 and which slides along the frame 36 of the partition feeder 10 in a direction determined by the rotation of the screw drive 60. The operation of the motor 56 therefore causes the paddle 12 to move toward or away from the tabbing 18, depending upon the direction in which the motor 56 is energized.

Figure 4:
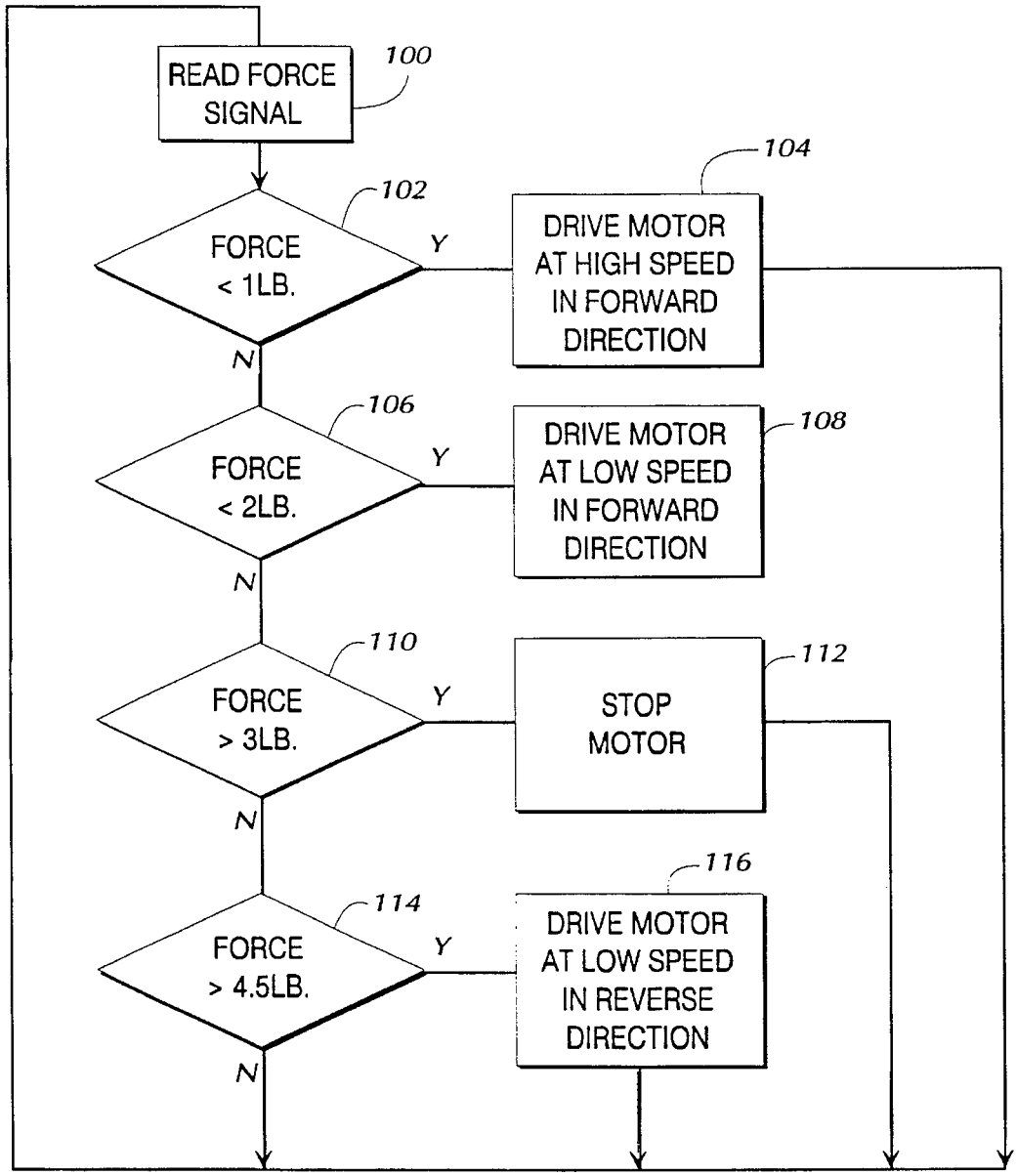
FIG. 4 is a flow chart of operations for a programmable logic controller.

The PLC 52, according to a flow chart shown in FIG. 4, first reads the force signal at step 100 and determines at step 102 whether the force is less than a first threshold amount. If the force is less than the first threshold amount, the force is too low and, at step 104, the PLC 52 energizes the motor 56 at a high speed in a direction that causes the paddle 12 to travel toward the tabs 18. If the PLC 52 determines at step 106 that the force is above the first threshold amount but below a second threshold amount, the force is still too low and at step 108 the PLC 52 energizes the motor 56 at a low speed in the direction causing the paddle to travel toward the tabs 18.

If, at step 110, the PLC 52 determines that the force is above a third threshold amount, the force has reached the optimal amount and the PLC 52 stops the travel of the paddle 12 at step 112. At step 114, if the force is above a fourth threshold amount, the force is too high and at step 116 the PLC 52 energizes the motor 56 in the opposite direction at the low speed to move the paddle 12 away from the tabs 18. After controlling the motor 56 in one of steps 104, 108, 112, or 116, the routine repeats to ensure that the force at the tabs 18 is maintained at an optimal value or at least remains within an acceptable range of values.

In the embodiment shown in FIG. 1, the force at the tabs 18 is preferably maintained at about 3 lbs. To maintain this amount of force at the tabs 18, the first, second, third, and fourth threshold amounts are set at 1 lb., 2 lbs., 3 lbs., and 4.5 lbs., respectively. Thus, the paddle 12 is moved at the high speed toward the tabs 18 when the force is less than 1 lb., is moved at the low speed toward the tabs 18 when the force is less than 2 lbs. but above 1 lb., is stopped when the force is at 3 lbs., and is moved away from the tabs 18 when the force is greater than 4.5 lbs.

In the preferred embodiment, the load cell 42 samples at a rate of 10 times per second and is manufactured by Houston Scientific under Part No. 1250-0050. The signal conditioner 50 is a Digitec Model No. D 3240H, which additionally provides a digital readout of the force to an operator of the partition feeder 10, the PLC 52 is an Allen-Bradley Model No. PLC 5, and the driver 54 is a Pacific Scientific Model No. 5240. These particular components are only examples of how the invention may be constructed, other components which accomplish the same or similar functions may alternatively be used.

Figure 5:
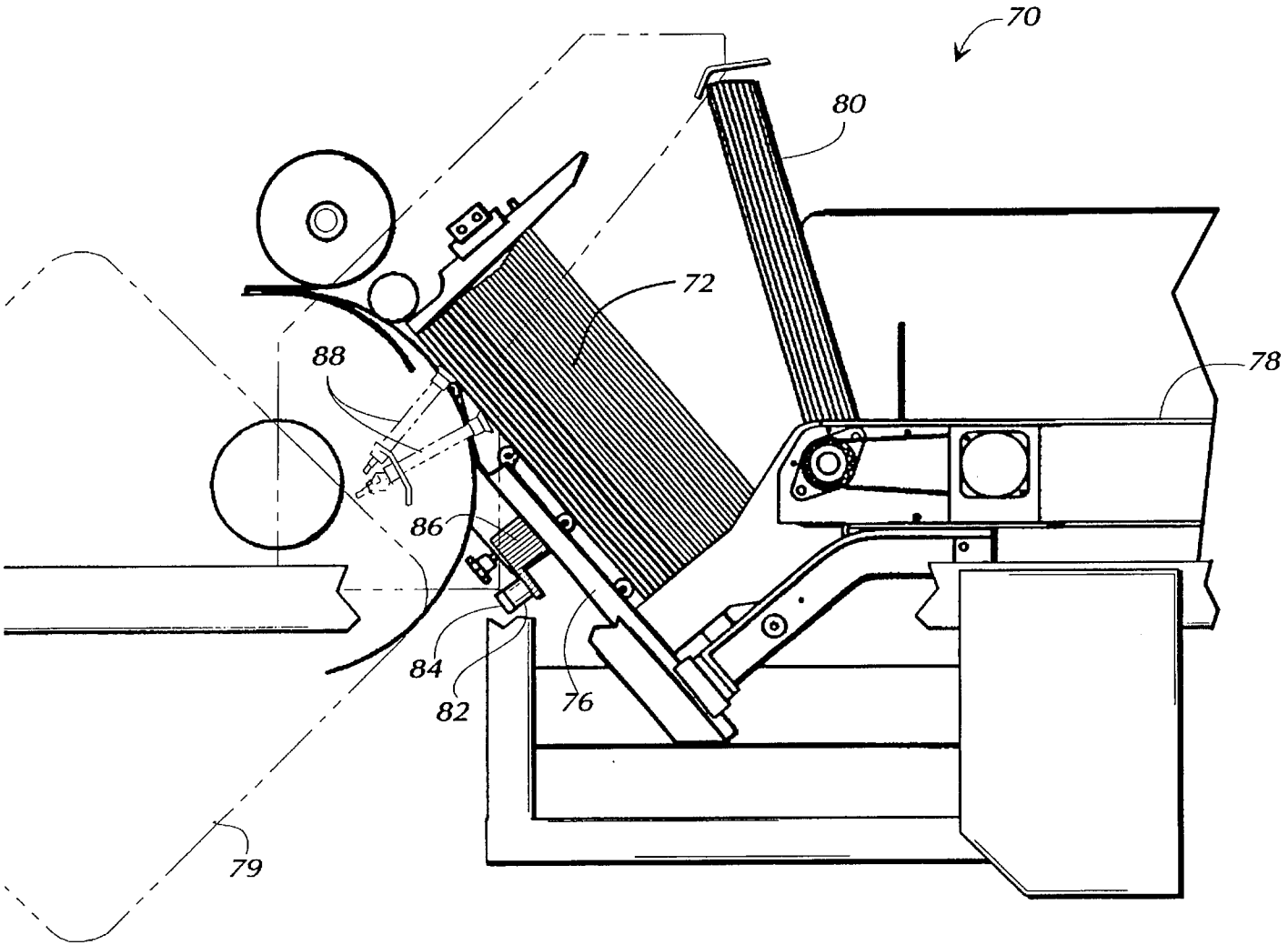
FIG. 5 is a partial perspective view of a carton feeder with the force sensing assembly according to FIG. 1.

In a second embodiment of the invention, as shown in FIG. 5, a carton feeder 70 has a main stack 72 of cartons formed between a pair of side rails or other type of framing. The stack 72 is formed at a downward angle so that the weight of the stack 72 is applied against a lever arm 76 causing the lever arm 76 to pivot in a counter clockwise direction about a pivot point (not shown) at one end of the lever arm 76. A block 86 is mounted on the lever arm 76 and has a flange for applying the weight of the stack 72 to one end of a spring 82, which is preferably a urethane spring. The other end of the spring 82 is forced against a load bearing surface of a load cell 84, which is mounted to the frame of the carton feeder 70 in any suitable manner. A selecting apparatus, such as the rotary head 79 with vacuum assemblies 88, removes a single carton from an end of the stack 72.

The signals from the load cell 84 are preferably processed by a signal conditioner and then supplied to a PLC. The PLC controls a conveyor belt 78 to drop cartons from a reserve stack 80 into the main stack 72 when the weight of the stack 72 is too low. The PLC, in one possible routine, could advance the conveyor belt 78 at a first speed if the force sensed at the load cell 84 were less than a first threshold level and then decrease the speed as the force approached the optimal force. When the weight of the stack 72 becomes greater than a certain amount, the PLC would stop the conveyor belt 78 completely or at least reduce the speed of the conveyor belt 78. The program for the PLC in the carton feeder 70 can be structured in various ways and is not limited to the example disclosed.

Moreover, the invention is not limited to the disclosed settings of the threshold amounts nor is it limited to the disclosed approaches in controlling the position of the paddle. The number of threshold levels and the values for the threshold levels may be varied to provide a greater or lesser amount of control over the force. Also, instead of controlling the speed of the paddle 12 or conveyor belt 78, the PLC could control the position of the paddle 12 or conveyor belt 78. Other variations in the control of the force will be apparent to those skilled in the art.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

What is claimed is:

1. A force sensing assembly, for use in a product delivery system which successively removes products from one end of a stack of products and which forces said products toward said one end of said stack, said force sensing assembly comprising:

tabbing means for contacting a product located at said one end of said stack and for receiving a force supplied from the product;

means for measuring said force and for generating a force signal; and control means for receiving said force signal from said measuring means and for adjusting said force until said force equals a desired force.

2. The force sensing assembly as set forth in claim 1, wherein said tabbing means comprises at least one tab.

3. The force sensing assembly as set forth in claim 1, wherein said product comprises a carton for holding beverage containing articles.

4. The force sensing assembly as set forth in claim 1, wherein said product comprises an insert for separating beverage containing articles.

5. The force sensing assembly as set forth in claim 1, wherein said measuring means comprises a load cell and a spring having a first end receiving said force and a second end connected to said load cell.

6. The force sensing assembly as set forth in claim 5, wherein said measuring means further comprises:

a cross-bar extending across a longitudinal axis of said stack, said tabbing means being fastened to said cross-bar;

a lever having a first arm connected to said cross-bar and a second arm connected to said first end of said spring;

said cross-bar being displaced with said force, said lever being rotated with said force, and said force being transferred from said tabbing means to said load cell.

7. The force sensing assembly as set forth in claim 6, wherein a length of said first arm is equal to a length of said second arm.

8. The force sensing assembly as set forth in claim 5, wherein said measuring means further comprises a stopping member for limiting an amount said spring is compressed.

9. The force sensing assembly as set forth in claim 5, wherein said spring comprises a urethane spring.

10. The force sensing assembly as set forth in claim 1, wherein said control means comprises:

a paddle for traveling along said longitudinal axis and for contacting a product located at an opposite end of said stack as said one end;

a motor for adjusting a speed of said paddle; and a controller for controlling said motor based upon said force signal supplied from said measuring means.

11. The force sensing assembly as set forth in claim 10, wherein said controller comprises a programmable logic controller.

12. The force sensing assembly as set forth in claim 10, further comprising a signal conditioner for receiving said force signal and for producing a scaled voltage signal which is supplied to said controller.

13. The force sensing assembly as set forth in claim 10, further comprising a signal conditioner for receiving said force signal and for producing a scaled current signal which is supplied to said controller.

14. The force sensing assembly as set forth in claim 10, further comprising a signal conditioner for receiving said force signal and for producing a first signal when said force falls within a first range of forces and for producing a second signal when said force falls within a second range of forces, said first and second signals being supplied to said controller.

15. The force sensing assembly as set forth in claim 10, further comprising a screw shaft extending along said longitudinal axis, said paddle being attached to said screw shaft, and said motor being geared to rotate said screw shaft to move said paddle along said longitudinal axis.

16. The force sensing assembly as set forth in claim 1, wherein said stack is formed at an angle so that the product at the one end is lower than any other product in the stack, said control means comprises:

a conveyor belt holding a reserve products;

a motor for advancing said conveyor belt so that said reserve products join said stack of products at an end of said stack opposite said one end; and a controller for driving said motor based upon said force signal supplied from said measuring means.

17. The force sensing assembly as set forth in claim 16, wherein said controller comprises a programmable logic controller.

18. The force sensing assembly as set forth in claim 16, further comprising a signal conditioner for receiving said force signal and for producing a scaled voltage signal which is supplied to said controller.

19. The force sensing assembly as set forth in claim 16, further comprising a signal conditioner for receiving said force signal and for producing a scaled current signal which is supplied to said controller.

20. The force sensing assembly as set forth in claim 16, further comprising a signal conditioner for amplifying said force signal and for producing a first signal when said force falls within a first range of forces and for producing a second signal when said force falls within a second range of forces, said first and second signals being supplied to said controller.

21. The force sensing assembly as set forth in claim 10, wherein said controller controls a speed and direction of said paddle.

22. The force sensing assembly as set forth in claim 16, wherein said controller controls a speed of said conveyor belt.

23. A method for controlling a force generated at tabbing in a product delivery system which successively removes products from one end of a stack of products and which forces said products toward said one end, said method comprising the steps of:

providing at least one tab at said one end of said stack for contacting a product at said one end of the stack;

receiving with said tab a force supplied by said product at the one end of the stack;

transferring said force to a load cell;

sensing said force with said load cell; and adjusting said force at said one end until said force equals a desired force.

24. The method as set forth in claim 23, wherein said step of transferring said force to said load cell comprises the steps of:

applying said force to a cross-bar upon which said tab is attached;

displacing said cross-bar a distance proportional to a magnitude of said force; and transferring said force from said cross-bar to a spring having one end affixed to said load cell.

25. The method as set forth in claim 24, wherein said displacing and transferring steps comprise the steps of rotating said cross-bar with said force, converting with a bell crank a rotary force of said cross-bar into a translational force, and applying said translational force from said bell crank to said spring.

26. The method as set forth in claim 23, wherein said step of adjusting said force comprises the step of adding products to said stack in order to increase said force.

27. The method as set forth in claim 23, wherein said step of adjusting said force comprises the step of adjusting a position of a paddle contacting an opposite end of said stack as said one end.

28. The method as set forth in claim 23, wherein said step of adjusting said force comprises the step of adjusting a speed of a paddle contacting an opposite end of said stack as said one end.

29. The method as set forth in claim 28, wherein said step of adjusting said force further comprises the step of adjusting a direction of travel of said paddle.

* * * * *